United States Patent [19]

Nagy et al.

[11] 3,938,545

[45] Feb. 17, 1976

[54] ACCESS COVER WITH MOVEABLE ATTACHING DEVICES FOR UNDERGROUND PUMPING STATIONS AND OTHER INSTALLATIONS

[75] Inventors: Nicholas Nagy, Westport; Clinton F. Egerton, Stamford, both of Conn.

[73] Assignee: International Telephone and Telegraph Corporation, Nutley, N.J.

[22] Filed: Nov. 15, 1974

[21] Appl. No.: 524,098

[52] U.S. Cl. ..... 137/363; 417/360; 52/21; 52/710

[51] Int. Cl.[2] ..... E02D 29/14

[58] Field of Search ..... 137/363; 52/19, 21, 221, 52/710; 415/126, 119; 417/360; 222/180, 255, 333

[56] References Cited

UNITED STATES PATENTS

| | | | |
|---|---|---|---|
| 2,380,379 | 7/1945 | Attwood | 52/710 X |
| 3,018,925 | 1/1962 | Englesson | 417/360 UX |
| 3,173,227 | 3/1965 | Clark | 52/221 X |
| 3,435,568 | 4/1969 | Hoseason et al. | 52/221 |
| 3,519,072 | 7/1970 | Hilden | 417/360 X |
| 3,592,564 | 7/1971 | Conery | 417/360 |
| 3,743,447 | 7/1973 | Lynch | 417/360 |
| 3,771,914 | 11/1973 | Crespo | 417/360 |

*Primary Examiner*—Henry T. Klinksiek
*Attorney, Agent, or Firm*—John T. O'Halloran; Menotti J. Lombardi, Jr.; Peter Van Der Sluys

[57] ABSTRACT

An underground station is provided with an access cover assembly including a frame extending about an access opening and a cover hingedly attached to said frame. A support member is attached to said frame and extends about the periphery of the access opening. Attaching members are slidably mounted to said support member so that they may be positioned to any desired location about the periphery of the access opening. Fastening means are provided for fixing said attaching members at desired locations about the support member and for fastening station accessories to the attaching member so that the accessories may be mounted in preferred locations in a particular station.

16 Claims, 6 Drawing Figures

ACCESS COVER WITH MOVEABLE ATTACHING DEVICES FOR UNDERGROUND PUMPING STATIONS AND OTHER INSTALLATIONS

BACKGROUND OF THE INVENTION

1. Field of the Invention

The present invention relates to underground stations and more particularly to an underground station having an access cover with a versatile attaching frame.

2. Description of the Prior Art

Underground stations such as pumping stations require access openings which are usually closed by access covers formed from a strong rigid material such as steel. The more sophisticated covers are mounted in a welded frame which is cast into a concrete slab formed about the access opening. The access covers are mass produced and mounted in the frame without regard to the specific requirements of a particular pumping station. Various accessories such as guide holders, cable holders, chain hooks, ladders, fluid level sensors and power outlets are commonly mounted to the access cover frame. The frame is provided with predrilled mounting holes disposed in predetermined locations for the purpose of mounting these accessories. Threaded nuts are usually welded on the rear side of the frame in alignment with predrilled holes for receiving accessory mounting bolts.

Experience has shown that in many instances the nuts are misaligned and do not coincide with the predrilled holes so that the accessory mounting bolts cannnot be threaded into the nuts. Unfortunately, this condition is usually discovered after the frame is cast into the concrete slab and the problem may not be corrected without breaking the concrete away to gain access to the rear side of the mounting frame. This has proven to be an expensive and time consuming operation in addition to substantially degrading the overall appearance of the pumping station after the concrete is repaired.

The frames are mass produced with a number of mounting holes disposed in predetermined locations without regard to the preferred requirements of a particular pumping station. The prior art access covers lacked the versatility that is desired for simplifying installation and obtaining the most efficient station installation. The hinges were attached to the frame on a predetermined side without regard to the pumping station location which resulted in problems if an obstruction happened to be located in the access area.

To provide the most efficient pumping station, the previously mentioned accessories should be mounted in locations that can be determined only after the pumping station locations are completely surveyed. The preferred locations for the junction boxes for power cables and sensor cables will be dictated by the location of the power source at the station. The pumps used in the station usually require level sensors that are preferably mounted in an area remote from the fluid inlet where turbulence is usually experienced. Thus, it is important to have the flexibility to be able to locate the sensors in the area of least turbulence. The pumps themselves should be mounted in a location convenient to the discharge outlet.

Thus, the prior art access covers not only resulted in problems with misaligned mounting holes, they also lacked the necessary flexibility for proper installation of an efficient pumping station.

SUMMARY OF THE INVENTION

The present invention contemplates an underground station such as a pumping station including an access cover that is inexpensive and has the necessary versatility to provide an efficient and well designed station. The access cover includes a cover frame having a support member formed about the periphery of the access hole. Threaded attaching members are slideably mounted to the support means and may be positioned to any desired location for receiving accessory fastening bolts.

The versatility provided by the invention allows for the rapid installation of an efficient pumping station wherein the level sensors may be positioned in an area of least turbulence and the junction boxes for the sensor cables and power cables may be positioned near the power source.

In one embodiment of the invention, an adaptor is utilized for mounting a hinge so that the cover may be mounted to open in the preferred direction most suited to the area surrounding the pumping station.

Thus, each accessory may be located in its preferred position which can be selected during installation of the pumping station.

The difficulties experienced with misaligned mounting holes are obviously eliminated by the use of the present invention. The frame can be cast in concrete without fear of misaligned holes or concern over the best orientation of the frame.

In a preferred embodiment, the frame is manufactured from commercially available components which are merely welded together to form standard sized covers.

Thus, the present invention provides an inexpensive access cover manufactured from standard commercially available components. The invention provides the flexibility required for well designed pumping stations since it may be adapted to any particular local condition. The need for substantial inventories of various types and shapes of special access covers may be eliminated since the present invention is adaptable to a variety of needs. The difficulties experienced with predrilled mounting holes are entirely eliminated thereby saving installation time and expense.

The primary objective of the present invention is to provide an efficient underground pumping station at the lowest possible cost.

Another objective of the present invention is to provide an inexpensive access cover.

Another objective of the present invention is to provide an access cover including a cover frame adapted to mount a plurality of pumping station accessories.

Another objective of the present invention is to provide an access cover having a cover frame wherein accessories may be mounted in any desired position without the need for predrilled mounting holes.

The foregoing and other objectives and advantages of the present invention will become more apparent from the following description and the accompanying drawings wherein one embodiment of the present invention is described.

DESCRIPTION OF THE PREFERRED EMBODIMENT

Figure 1:
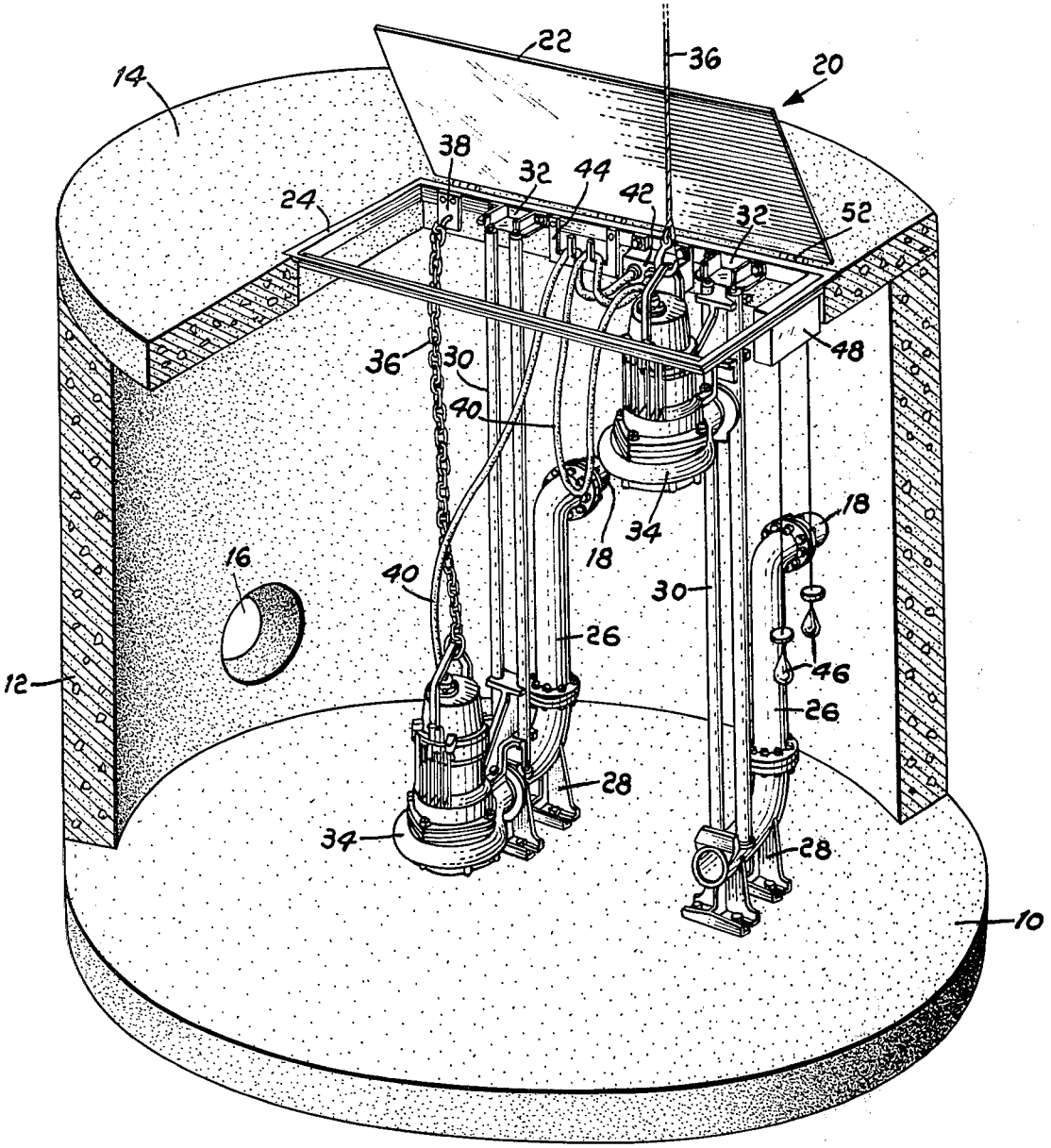
FIG. 1, is a perspective view of an underground pumping station shown partially in section.

Referring to FIG. 1, there is shown a typical underground pumping station having a sump basin including a concrete floor 10, side walls 12 and a concrete cap 14. A liquid inlet opening 16 is provided at a predetermined position within the basin wall and a pair of liquid discharge outlets 18 are also provided in the wall at predetermined locations. An accesss cover assembly 20 having a cover plate 22 and a frame 24 is cast in concrete cap 14. During installation, the concrete cap is formed within an enlarged opening into which the cover assembly 20 is positioned and thereafter grouted in place.

Discharge pipes 26 are permanently mounted in the sump basin and each have one end attached to a liquid discharge outlet 18 and another end attached to an automatic discharge connection adaptor 28 which is fixedly mounted to the sump floor 10. Extending from each of the automatic discharge connection adaptors 28 are a pair of vertically disposed guide bars 30 which are supported on their upper ends by upper guide bar brackets 32 mounted to frame 24. A pair of electrical submersible pumps 34 are slideably disposed on guide bars 30 and have discharge outlets adapted for automatic connection to the discharge connection adaptors 28 when lowered into the sump basin. Lifting chains 36 are provided for lifting the pumps out of the sump basin. When not in use, the chains 36 are connected to chain hooks 38 attached to frame 24. Power cables 40 connect pumps 34 to a junction box 42 mounted to frame 24 for providing power to the pumps. The power cables are preferably suspended from a cable hanger 44 also connected to the frame 24. A plurality of float type level sensors 46 are suspended from a sensor control box 48 also mounted to the frame 24.

A review of FIG. 1 will clearly indicate that it is desirable to mount the sensor control box 48 at a position remote from the liquid inlet opening 16 so that the float type sensors 46 are not adversely effected by the turbulence created by incoming liquid. The automatic discharge connection adaptors 28 must be positioned adjacent the liquid discharge outlets 18. Thus, the particular position of the upper guide bar brackets 32 depend upon the location of the liquid discharge outlets 18. The preferred position for mounting junction box 42 and cable hanger 44 will be dictated by the location of the power source for the pumping station. Thus, it is desirable to provide a frame 24 wherein the accessories may be mounted at any location depending upon the configuration of and local conditions surrounding a particular pumping station.

Figure 2:
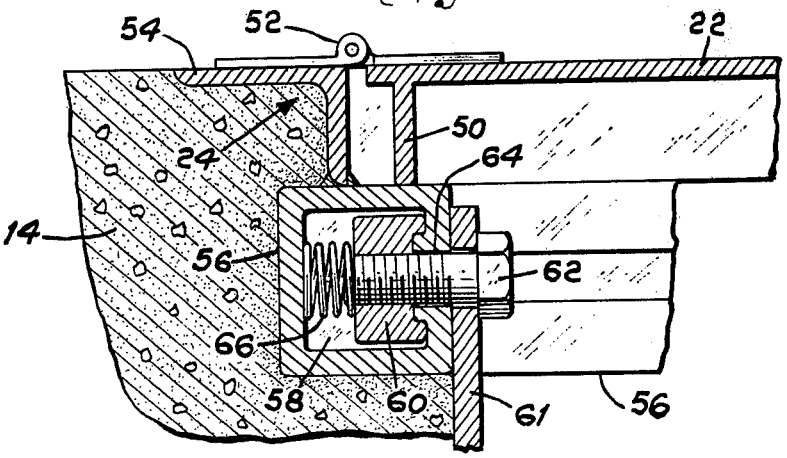
FIG. 2, is a vertical section showing the frame and cover of the present invention.

Referring to FIG. 2, there is shown a vertical section of a portion of a cover assembly 20 mounted in a concrete cap. In a preferred embodiment, a cover 22 is formed of 1/8 inch checkered steel plate having steel re-enforcing braces 50 welded to the underside thereof for providing additional strength and rigidity. Hinges 52 are provided having one leaf attached to the cover 22 and a second leaf attached to the frame 24.

Frame 24 comprises an angle iron member 54 having one leg thereof welded to an upper side of a channeled support member 56 having a channel 58 and a slot 64 formed on an exposed side therreof. The slotted channeled support member may be a commercially available product such as a P1000 channel manufactured by Unistrut Corporation or a VA-1 channel manufactured by Versabar Corporation. These channels may be made of steel, stainless steel or aluminum depending upon design requirements. Disposed within the channel 58 is a sliding attachment member in the form of a threaded nut 60 adapted to receive a fastening blot 62 through slot 64. An accessory 61 is mounted between bolt 62 and channeled support member 56. It is desirable to provide a resilient member such as spring 66 between nut 60 and the rear wall of the channel to facilitate positioning of the nut in the channel. The resilient member is preferably attached to the sliding nut.

Figure 3:
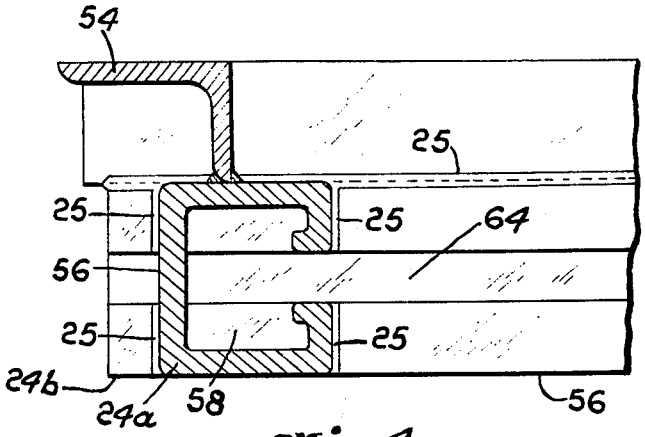
FIG. 3, is a vertical section of the present invention.

Frame 24 may be formed in a rectangle by welding straight frame sections together at right angles as shown in FIG. 3 or if desired could be formed of curved materials to provide a circular or oval shaped access cover.

Figure 4:
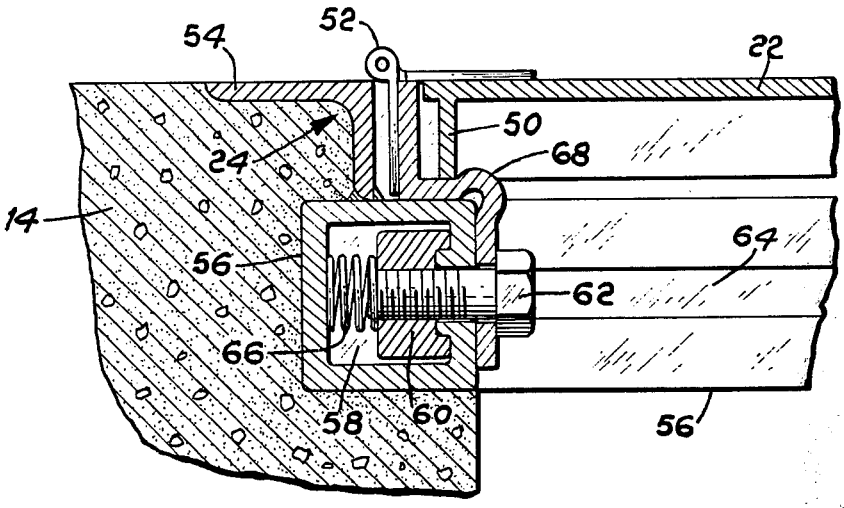
FIG. 4, is a vertical section showing the present invention including a hinge mounting bracket.

Referring to FIG. 3, a straight frame section **24*a* is welded to another frame section 24*b* at weld points 25 for forming a rectangularly shaped frame. Referring to FIG. 4, a hinge mounting bracket 68** is shown for providing flexibility in the positioning of the hinges to the desired location in the pumping station.

Figure 5:
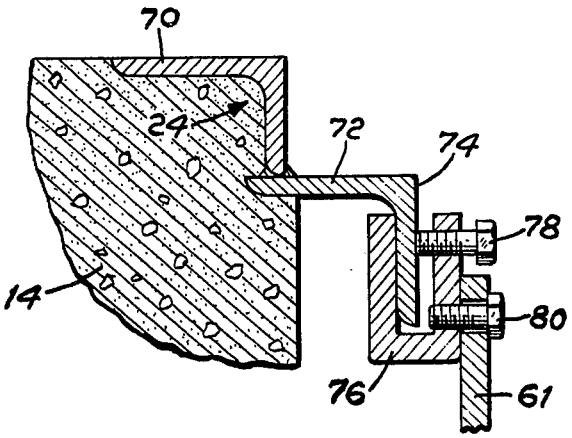
FIG. 5, is a vertical section showing another embodiment of the present invention.

In a simplified embodiment of the present invention shown in FIG. 5, the frame 24 is formed of two angle iron members 70 and 72 welded together to provide a frame member 70 and a support member 72 having a depending flange 74 extending about the periphery of the frame. A mounting clamp 76 is slideably disposed about the frame 24 and may be fixed in any desired location by tightening bolt 78. Clamp 76 has a threaded opening for receiving accessory mounting bolt 80. The embodiment of FIG. 5 is shown by way of example as having a depending flange. It is to be understood that said flange could be horizontally disposed or could be extending upwardly depending upon design preference.

Figure 6:
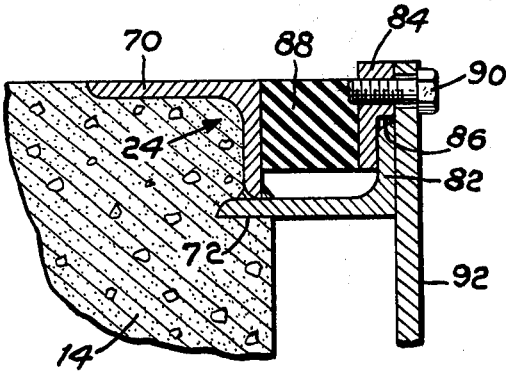
FIG. 6, is a vertical section of another embodiment of the present invention.

Referring to FIG. 6 there is another embodiment of the present invention wherein angle iron support member 72 has a leg 82 disposed upwardly and an attaching member 84 is disposed in a channel formed between leg 82 and one leg of angle iron 70. Attaching member 84 has a shoulder 86 adapted to ride on leg 82. Resilient material 88 is disposed between angle iron support member 72 and leg 82 for holding member 84 in place. Fastening bolt 90 engages an accessory 92 and is threaded into member 84 thereby securing member 84 in place on leg 82 and attaching accessory 92 to the frame.

The invention should not be construed to be limited to any particular configuration of mounting frame but rather towards the broader concept of providing an underground pumping station having an access cover assembly wherein the desired accessories may be positioned at any desired location.

Thus, the present invention allows for the construction of an efficient underground pumping station wherein the components and accessories may be positioned in the most desirable locations. The efficient operation of the pumping station is a direct result of the versatile access cover assembly which allows proper positioning of components. The cover assembly is manufactured from inexpensive commercially available components and eliminates the problems encountered with the prior art access covers relating to misalignment of components while being less expensive. Installation time is considerably reduced since the installer need not be concerned with the exact alignment of components. Thus, the present invention provides a more efficient pumping station at a lower cost than those heretofore available.

What is claimed is:

1. An underground pumping station, comprising:

a sump basin including a liquid inlet, a liquid outlet and a top having an access opening;

a pump disposed in said basin and having a discharge outlet connected to the liquid outlet of the basin;

a cover frame fixedly mounted in the top of the basin and extending about the periphery of the access opening;

a support member attached to said cover frame and extending about the periphery of the access opening;

a cover hingedly attached to one of said cover frame and support member for closing said access opening;

attaching members slidably mounted to said support member whereby the attaching members may be positioned to any desired location on the support member; and fastening means for engaging said attaching members and accessories to be mounted in the pumping station whereby said attaching members are fixed at a desired location on the support member and the accessories are attached thereto in the preferred location for a particular pumping station.

2. A pumping station as described in claim 1, wherein the support member comprises a flange extending from said frame, said flange being engaged by the attaching members in cooperation with the fastening means.

3. A pumping station as described in claim 2, wherein the attaching members comprise clamp members slideably disposed on said flange and said fastening means includes means for fixing said clamp at a desired location on said flange and means for attaching accessories to said clamp member.

4. A pumping station as described in claim 1, additionally comprising resilient means associated with said attaching members for slideably securing said attaching members to said support member.

5. A pumping station as described in claim 1, wherein said support member comprises a channeled member having a longitudinal slot formed along an exposed side thereof and extending about the periphery of the access opening, said attaching members being slideably disposed in said channel and adapted to engage an inner surface of said channeled member, said fastening means extending into said slot for engaging the attaching members, whereby an accessory may be disposed between the fastening means and the channeled member and secured thereto by said fastening means.

6. A pumping station as described in claim 5, additionally comprising resilient means disposed between said attaching members and a rear wall of said channeled member so that the attaching members are slideably held against the slotted side of the channeled member.

7. A pumping station as described in claim 1, additionally comprising hinge mounting brackets attached to said support member by said attaching members and fastening means, said cover being hingedly attached to said brackets.

8. An access cover assembly, comprising:

a frame member defining an access opening in the access cover assembly;

a support member attached to said frame member and extending about the access opening;

a cover hingedly attached to one of said frame member and support member for closing said access opening;

attaching members slidably mounted to said support member to be located at any desired position on the support member; and fastening means for engaging said attaching members and fixing said attaching members at a desired location on the support member, whereby an accessory used with the cover assembly may be attached to the support member in a preferred location by said fastening means.

9. An access cover assembly as described in claim 8, wherein the support member comprises a flange extending from said frame, said flange being engaged by the attaching members in cooperation with the fastening means.

10. An access cover assembly as described in claim 9, wherein the attaching members comprise clamp members slideably disposed on said flange and said fastening means includes means for fixing said clamp at a desired location on said flange and means for attaching accessories to said clamp member.

11. An access cover assembly as described in claim 8, additionally comprising resilient means associated with said attaching members for slideably securing said attaching members to said support member.

12. An access cover assembly as described in claim 8, wherein said support member comprises a channeled member having a longitudinal slot formed along an exposed side thereof and extending about the access opening in the frame, said attaching members being slideably disposed in said channel to engage an inner surface of said channeled member, said fastening means extended into said slot for engaging the attaching members, wherein an accessory may be disposed between the fastening means and the channeled member and secured thereto by said fastening means.

13. An access cover assembly as described in claim 12, additionally comprising resilient means disposed between said attaching members and a rear wall of said channeled member so that the attaching members are slideably held against the slotted side of the channeled member.

14. An access cover assembly as described in claim 8, additionally comprising hinge mounting brackets attached to said support member by said attaching members and fastening means, said cover being hingedly attached to said brackets.

15. An access cover assembly for an underground pumping station of the type in which a number of station accessories are suspended from the access cover assembly, comprising:

a frame member defining an access opening the access cover assembly;

a cover hingedly attached to said frame member;

a track member formed on said frame member and extending about the access opening;

a cover hingedly attached to one of said frame members and track member for closing said access opening;

attaching members slideably mounted to said track member for positioning at any desired location about the access opening; and fastening means for fixing the attaching members at a desired location and for attaching accessories to the access cover assembly.

16. An underground pumping station, comprising:

a sump basin including a liquid inlet, a liquid outlet and a top having an access opening;

a pump disposed in said basin and having a discharge outlet;

a cover frame fixedly mounted in the top of said basin and extending about the periphery of the access opening;

a support member attached to said cover frame and extending about the periphery of the access opening;

a cover hingedly attached to one of said cover frame and support member for closing said access opening;

attaching members slidably mounted to said support member whereby the attaching members may be positioned to any desired location on the support member;

fastening means for engaging said attaching members and for mounting accessories in the pumping station, whereby said attaching members are fixed at a desired location on the support member and the accessories are attached thereto in the desired location for a particular pumping station; and means for supporting said pump in said basin, said supporting means being connected to the support member at a selected position by said slidably mounted attaching members and fastening means so that the pump discharge outlet is aligned with the sump basin liquid outlet.

* * * * *